US010597831B2

(12) United States Patent
Menard et al.

(10) Patent No.: US 10,597,831 B2
(45) Date of Patent: Mar. 24, 2020

(54) ROLLING DEVICE, IN PARTICULAR FOR PLACING BULK MATERIALS ON THE GROUND

(71) Applicant: RKM, Ermenonville (FR)

(72) Inventors: Kevin Menard, Ermenonville (FR); Romain Menard, Le Boupere (FR); Medhi Menard, Le Boupere (FR)

(73) Assignee: RKM, Ermenonville (FR)

( * ) Notice: Subject to any disclaimer, the term of this patent is extended or adjusted under 35 U.S.C. 154(b) by 0 days.

(21) Appl. No.: 16/300,112

(22) PCT Filed: May 4, 2017

(86) PCT No.: PCT/FR2017/051071
§ 371 (c)(1),
(2) Date: Nov. 9, 2018

(87) PCT Pub. No.: WO2017/194859
PCT Pub. Date: Nov. 16, 2017

(65) Prior Publication Data

US 2019/0145064 A1 May 16, 2019

(30) Foreign Application Priority Data

May 10, 2016 (FR) ..... 16 54149

(51) Int. Cl.
*E01C 19/00* (2006.01)
*E01C 19/48* (2006.01)
*E01C 19/20* (2006.01)

(52) U.S. Cl.
CPC ..... *E01C 19/4873* (2013.01); *E01C 19/2005* (2013.01); *E01C 19/48* (2013.01); *E01C 2019/206* (2013.01); *E01C 2301/00* (2013.01)

(58) Field of Classification Search
CPC ..... E01C 19/4873; E01C 2301/00; E01C 19/4848; E01C 2019/206
(Continued)

(56) References Cited

U.S. PATENT DOCUMENTS 1,419,537 A * 6/1922 Bellar ..... E01C 19/4873 404/110
1,641,703 A * 9/1927 Stanton ..... E04G 21/04 404/110

(Continued)

FOREIGN PATENT DOCUMENTS

WO WO 00/6180 A1 10/2000

OTHER PUBLICATIONS

International Search Report, dated Jul. 17, 2017, from corresponding PCT application No. PCT/FR2017/051071.

(Continued)

*Primary Examiner* — Raymond W Addie
(74) *Attorney, Agent, or Firm* — Young & Thompson

(57) ABSTRACT

A rolling device includes a chassis equipped with a reservoir for holding bulk materials and a smoothing table, the smoothing table having a leading edge arranged transversely to the direction of movement of the device, and the bottom of the reservoir being provided with a discharge opening arranged between the leading edge of the smoothing table and the wheels of the rolling chassis of the device, the wheels of the rolling chassis being driven and the rolling chassis being mounted so as to be able to tip about the axis of rotation of the wheels, the reservoir and the smoothing table forming a movable assembly, and the position of the movable assembly can be adjusted by an adjustment unit so as to be able to adjust the height of the smoothing table and the discharge opening, and the inclination of the smoothing table.

10 Claims, 6 Drawing Sheets

(58) Field of Classification Search
USPC ..... 404/85, 101, 105, 108, 110, 111, 118
See application file for complete search history.

(56) References Cited

U.S. PATENT DOCUMENTS 1,811,324 A * 6/1931 Lockard ..... E01C 23/098
222/624
1,858,645 A * 5/1932 Smoot ..... B28C 7/0076
222/503
2,197,878 A * 4/1940 Robinson ..... E01C 19/21
404/110
2,311,726 A * 2/1943 Blue ..... A01C 15/16
222/160
2,376,018 A * 5/1945 Sohmer ..... E01C 23/166
406/146
2,539,253 A * 1/1951 Jorgensen ..... A01C 3/00
111/132
4,496,265 A * 1/1985 Fragale ..... E01C 19/185
404/110
4,566,823 A * 1/1986 May ..... E01C 19/4893
404/98
4,871,025 A * 10/1989 Mayfield ..... E02F 3/7663
172/4.5
5,234,128 A * 8/1993 Hill ..... E01C 19/2005
222/52
5,387,051 A * 2/1995 Valente ..... E04F 21/20
404/84.05
6,050,744 A * 4/2000 Binning ..... E01C 19/185
404/108
2012/0257927 A1* 10/2012 Schmidt ..... E01C 23/0973
404/110

OTHER PUBLICATIONS

French Search Report, dated Oct. 14, 2016, from corresponding FR application No. 1654149.

* cited by examiner

ROLLING DEVICE, IN PARTICULAR FOR PLACING BULK MATERIALS ON THE GROUND

FIELD OF THE INVENTION

The invention relates to a rolling device, in particular for placing bulk materials on the ground in the form of a bed.

It more particularly relates to a device including a rolling chassis equipped with a reservoir for storing and distributing bulk materials and a smoothing table, the smoothing table having a leading edge arranged transversely to the direction of movement of the device, i.e., along the width of the device, and said reservoir being provided, in the lower part forming the bottom of the reservoir, with a discharge opening arranged between the leading edge of the smoothing table and the wheels of the rolling chassis of the device.

BACKGROUND OF THE INVENTION

Many machines or apparatuses for spreading and smoothing all types of coverings on the ground, in particular granulated and/or powdered road materials, asphalt or the like, have been developed, as for example illustrated by international application WO 00/61870.

The machines or apparatuses are generally hitched to a tractor device, making the assembly complex and bulky. Furthermore, the design of such devices or machines prevents following the profile of the ground, and traveling over a ground with a complex profile.

AIMS AND SUMMARY

One aim of the invention is to propose a device whose design makes it possible, with the help of a single operator, to transport, spread and smooth, very quickly and easily, a covering, while continuously following the profile of the ground for a precise deposition according to the preparation of the terrain.

Another aim of the invention is to propose a device whose design allows easy, effortless driving, and a passage in narrow circulation areas having a complex profile.

To that end, the invention relates to a rolling device in particular for depositing bulk materials on the ground in the form of a bed, said device including a rolling chassis equipped with a reservoir for storing and distributing bulk materials and a smoothing table, the smoothing table having a leading edge arranged transversely to the direction of movement of the device, i.e., along the width of the device, and said reservoir being provided, in the lower part forming the bottom of the reservoir, with a discharge opening arranged between the leading edge of the smoothing table and the wheels of the rolling chassis of the device, in order to deposit a bed of bulk material with a controlled thickness, characterized in that the rolling chassis is mounted so as to be able to tilt around a rotation axis of the wheels by means of which it rests on the ground in order for said device to go from a so-called working configuration in which the smoothing table is in bearing contact with the ground to a so-called transport configuration, in which the smoothing table is separated from the ground, in that the wheels of the rolling chassis are driving wheels, and in that the reservoir and the smoothing table form a movable assembly whose position is adjustable via adjusting means configured to allow, at least in the position in which the wheels of the rolling chassis rest on a horizontal flat ground and the smoothing table extends parallel to the ground, separated from the ground, on the one hand, an adjustment of the height of the smoothing table and the discharge opening by raising or lowering said assembly so as to move it further from or closer to the ground, and on the other hand adjusting the incline of the smoothing table so as to form a non-nil angle between the plane of the smoothing table and the rotation axis of the wheels.

The pivoting assembly of the chassis bearing the reservoir and the smoothing table around a rotation axis of the wheels of the chassis allows the smoothing table to be used as means for bearing on the surface having just been covered, while following the profile of the ground.

Adjusting the incline of the smoothing table with the plane of the discharge opening of the reservoir along this incline allows the discharge opening not to constitute an obstacle during the advance of the device. Adjusting the incline of the smoothing table, at least by pivoting of the smoothing table around an axis, parallel to the plane of the smoothing table, and transversely, in particular orthogonally with respect to the rotation axis of the wheels, so as to form, between the plane of the smoothing table and the rotation axis of the wheels, an acute angle on one side or the other of the device following the gradient of the ground, makes it possible to maintain the horizontality of the smoothing table, when the ground is not flat. Adjusting the height of the smoothing table and the discharge opening relative to the ground-bearing plane of the wheels of the chassis makes it possible to obtain a bed with a desired thickness.

According to one embodiment, the adjusting means configured for a height and incline adjustment of the smoothing table are at least partially shared.

According to one embodiment, the adjusting means include two actuators actuated independently each arranged between the chassis and the moving assembly.

According to one embodiment, each actuator is a jack, the rod of which is fastened to the chassis and the body of which is fastened via an arm to said moving assembly.

According to one embodiment, the longitudinal axis of said jack extends orthogonally to the rotation axis of the wheels.

Said longitudinal axis of each jack extends, preferably, substantially orthogonally, i.e., to within plus or minus 10°, to the plane of the smoothing table.

According to one embodiment, one of the arms and said moving assembly are coupled to one another via a pivot link with an axis transverse to the rotation axis of the wheels and parallel to the plane of the smoothing table and the other of the arms and said assembly are coupled to one another by a link with pivoting and sliding, the sliding being able to be done along a direction parallel to the leading edge of the smoothing table.

The use, as actuators, of jacks able to be controlled by the driver of the device allows a constant adjustment, including during the driving of the device. The driver thus has the possibility of performing, in real-time and continuously, an adjustment of the position of the smoothing table, when he observes a problem.

According to one embodiment, the device is equipped with a U-shaped handlebar, the branches of the U coupling the core of the handle-forming U to the jacks, and one of the branches of the U is coupled to one of the jacks so as to be movable by sliding along said jack. The sliding movement prevents twisting of the handlebar when a variation in length of the jacks is commanded with an adjustment of the length of the jacks that is differentiated from one jack to the other.

According to one embodiment, the reservoir open via the top is delimited by a so-called front transverse wall, a so-called rear transverse wall, and two so-called side longitudinal walls, the leading edge of the table extends at the base of the rear wall of the reservoir and the discharge opening is a closable opening. It is thus possible to fill the reservoir of the device in a location separate from the surface to be covered with a bed of bulk materials.

According to one embodiment, the reservoir is compartmentalized by partitions extending parallel to the longitudinal axis of the device considered along the movement direction of the device, the means for closing off the discharge opening include a series of hatches arranged side by side along the direction of the width of the device, said hatches being mounted movably between a closed position of the discharge opening in which said hatches are separated from one another by a partition and an open position of the discharge opening in which said hatches at least partially protrude from said reservoir, at least one of the hatches being able to move between the closed position and the open position independently of the other hatches, and the device is equipped with an end-of-travel stop for the hatches in the open position, the position of said end-of-travel stop being adjustable. The presence of a plurality of hatches inside a compartmentalized reservoir makes it possible to reduce the working width and/or the distribution flow rate.

According to one embodiment, the reservoir includes two flaps for adjusting the width of the bed of bulk materials to be deposited, each flap extending below means for closing off the discharge opening in the closed position of said discharge opening, each flap being, at its so-called upper edge, coupled to a side wall of the reservoir by a pivot link with a pivot axis parallel to the plane of the smoothing table for the passage of said flap from a position pressed against said side wall to a position separated from said side wall. These flaps therefore also participate in adjusting the working length.

BRIEF DESCRIPTION OF THE FIGURES

The invention will be better understood upon reading the following description of example embodiments, in reference to the appended drawings, in which.

Figure 1:
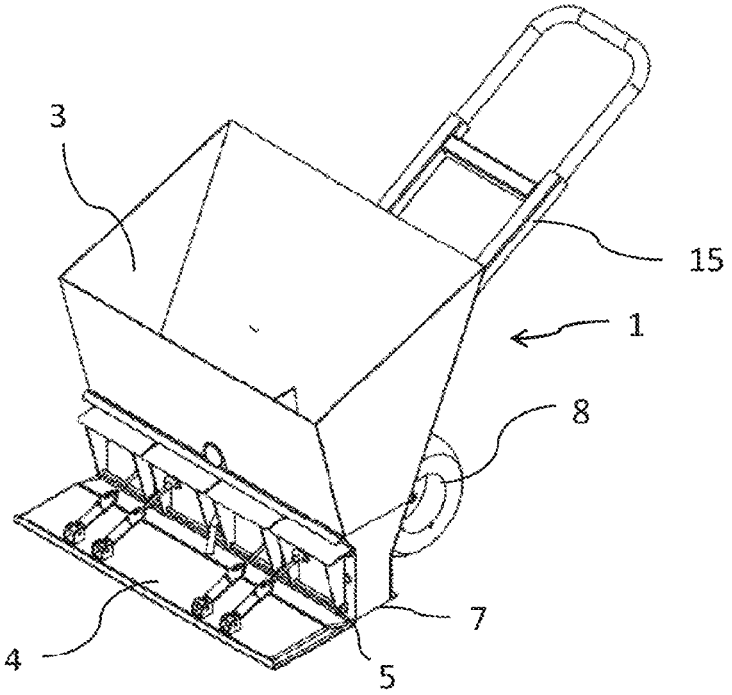
FIG. 1 shows a perspective view, on the smoothing table side, of a device according to the invention.
Figure 2:
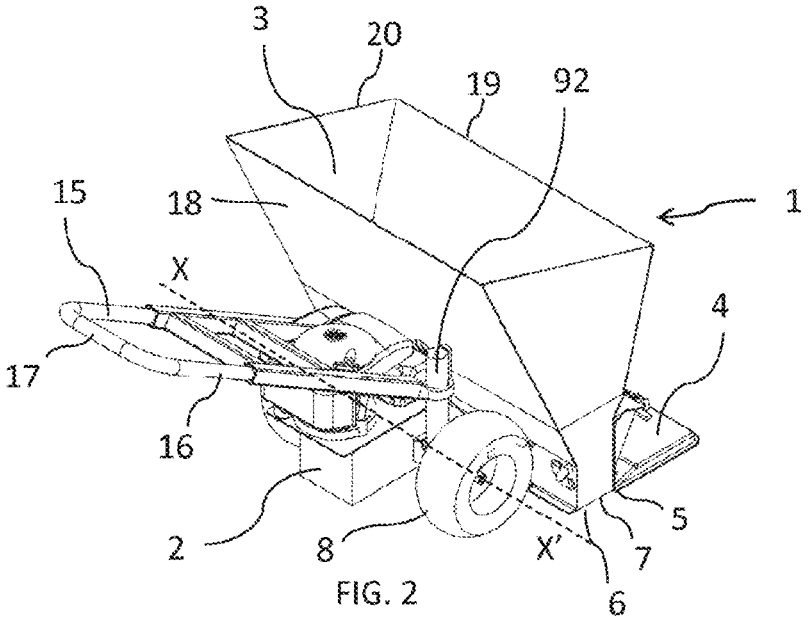
FIG. 2 shows a perspective view, on the handlebar side, of a device according to the invention.
Figure 3:
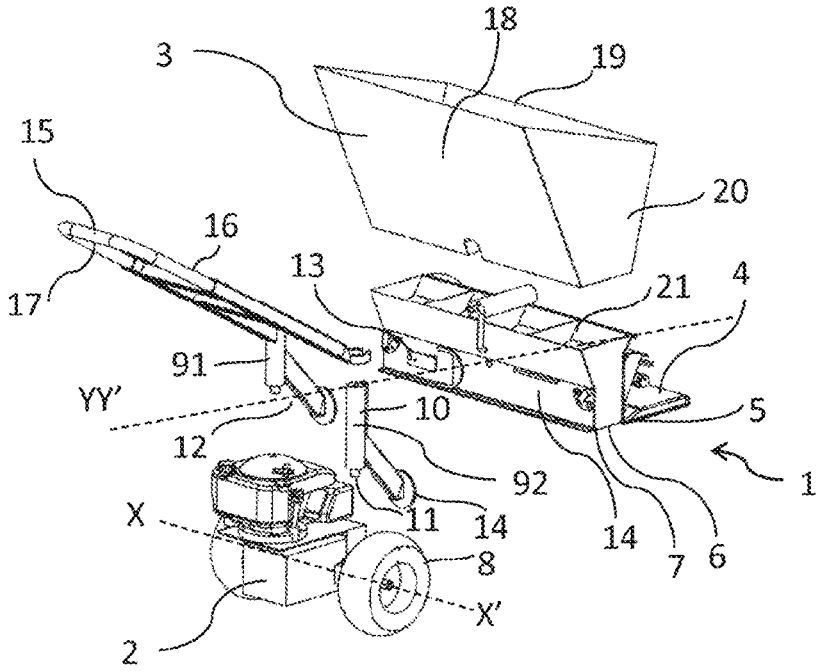
FIG. 3 shows an exploded view of the component elements of a device according to the invention.

As mentioned above, the invention relates to a self-propelled rolling device 1 for depositing, on the ground in the form of a bed or layer, bulk covering materials for roads, carriageways or other surfaces. These bulk materials can be made up of asphalt, sand, gravel or the like.

This device 1 is a self-propelled device 1 including a chassis 2 equipped with two wheels 8 bearing on the ground. These wheels 8 are driving wheels rotated around an axis XX'. To allow this rotational driving of the wheels, the device is equipped with a hydrostatic bridge to which each wheel 8 is coupled by a half-shaft, said hydrostatic bridge incorporating a differential and being coupled to a heat engine. Said rotational driving means of the wheels will not be described in more detail, since they are well known to those skilled in the art.

Other rotational driving means of the wheels, such as a battery-powered electric motor, could have been considered without going beyond the scope of the invention. In particular, the axle could have been made in one piece, and not separated like in the illustrated example.

The device further includes a reservoir 3 for storing and distributing bulk materials intended to form said covering, and a smoothing table 4, the storage reservoir 3 and the smoothing table 4 being mounted on the chassis 2.

In the illustrated example, the smoothing table 4 has a leading edge 5 arranged transversely to the movement direction of the device, i.e., along the width of the device 1, and the reservoir 3 is provided, in the lower part forming the bottom 6 of the device 3, with a discharge opening 7 arranged between the leading edge 5 of the smoothing table 4 and the wheels 8 of the rolling chassis 2 of the device 1. In particular, the reservoir 3 open via the top is, like a hopper, delimited by a so-called front transverse wall 18, a so-called rear transverse wall 19 and two so-called side longitudinal walls 20. The leading edge 5 of the smoothing table 4 extends at the base of the rear wall 19 of the reservoir 3 and the discharge opening 7 of the reservoir 3 is a closable opening.

Generally, the smoothing table 4, which can be formed by a simple metal sheet fastened to the reservoir, in particular to the rear wall 19 of the reservoir in line with its leading edge 5, has a width between 0.60 and 1.20 m and a length between 30 and 40 cm to form a large enough bearing surface.

In the illustrated example, the reservoir 3 is compartmentalized by partitions 21 extending parallel to the longitudinal axis of the device 1 considered along the movement direction of the device. The means 22 for closing off the discharge opening 7 include a series of hatches 221 arranged side by side in the direction of the width of the device. Said hatches 221 are mounted to be movable between a closed position of the discharge opening 7 in which said hatches extend at least partially inside the reservoir 3 and are separated from one another by a partition 21, and an open position of the discharge opening 7 in which said hatches 221 protrude at least partially from said reservoir 3. Said hatches 221 are hatches with a curved profile, with a concave side turned toward the bottom of the reservoir in the closed position. At least one of the hatches is able to move between the closed position and the open position, independently of the other hatches 221.

In the illustrated example, each hatch is associated with the jack arranged outside the reservoir and extending between the top of the smoothing table and the hatch. Said jack allows a sliding movement of the associated hatch, between a closed position and an open position of the discharge opening of the reservoir. It is thus possible to open some or all of the hatches, depending on the desired working width.

In order to vary the degree of opening of the hatches, and subsequently the distribution flow rate, the device may be equipped with an end-of-travel stop 23 of the hatches 221 in the open position. The position of said end-of-travel stop 23 is adjustable.

In the illustrated example, the end-of-travel stop 23 is formed by a control rod arranged outside the reservoir and able to be positioned, in the active position, on the trajectory followed by the hatches 221 during the passage from the closed position to the open position of the hatches 221. Said connecting rod, which extends along the width of the device, is thus housed at each of its ends in a flange protruding above the smoothing table. Said flanges extend across from one another and are each provided with a notch equipped with positioning indentations for the end of the control rod, to keep the control rod in the active position, i.e., on the trajectory followed by the hatches, or in the inactive position, i.e., outside the trajectory followed by the hatches.

In order to perfect this capacity of adjusting the width of the bed, the reservoir 3 includes two flaps 24 for adjusting the width of the bed of bulk materials to be deposited. Each flap 24 extends below the means 22 for closing off the discharge opening 7 in the closed position of said discharge opening 7. Each flap 24 is, at its so-called upper edge, coupled to a side wall 20 of the reservoir 3 by a pivot link with a pivot axis parallel to the plane of the smoothing table 4 for the passage of said flap 24 from a position pressed against said side wall 20 to a position separated from said side wall 20. The position of each flap is adjusted here manually using a pivoting lever outside the reservoir and engaged with the pivot axis of the flap. Said pivoting lever is able to occupy several angular positions as a function of the desired position for the flap.

Figure 8:
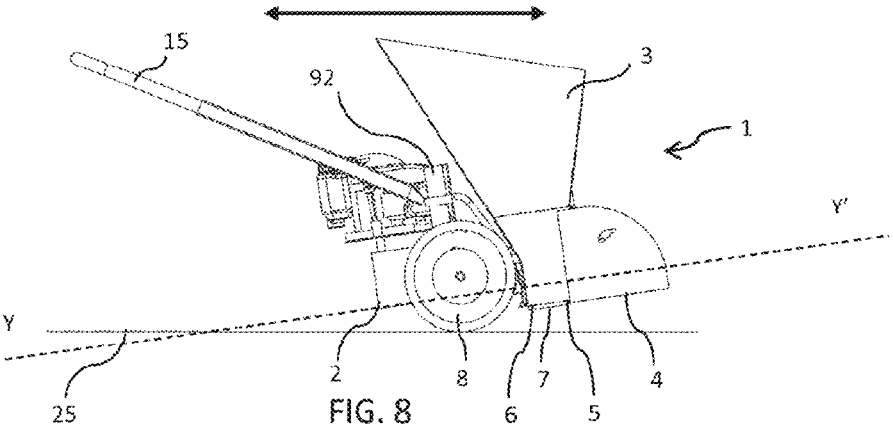
Figure 9:
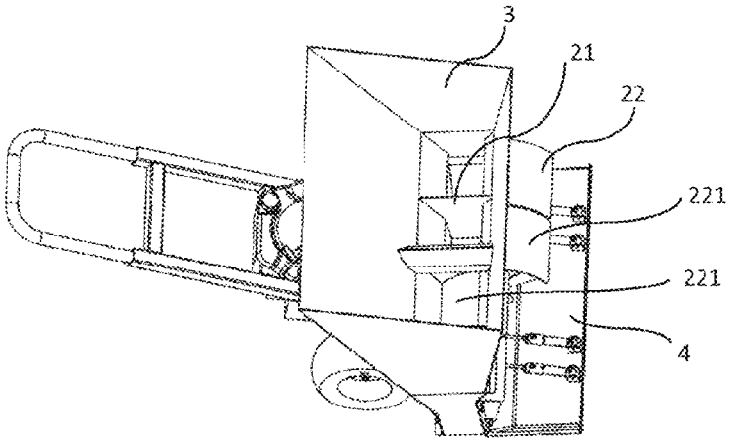
FIG. 9 shows an elevation view of the device, with two hatches in the open position.
Figure 10:
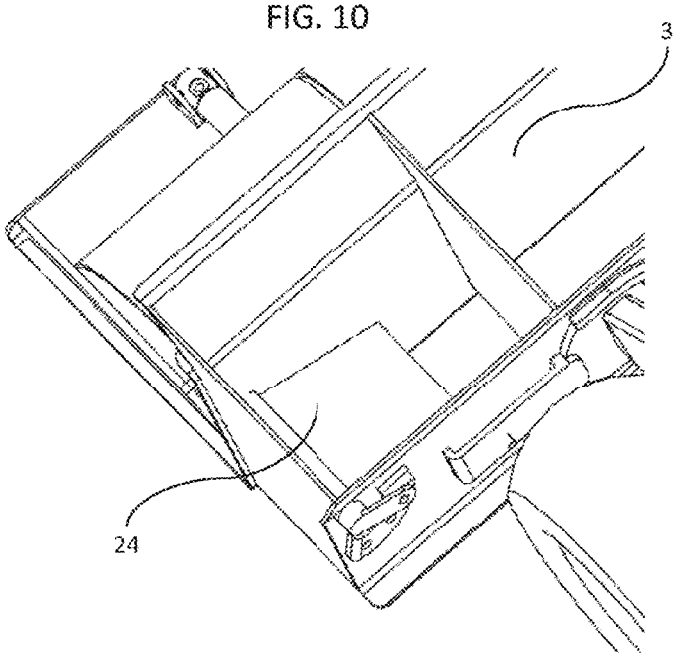
FIG. 10 shows a detail view of an adjusting flap.
Figure 11:
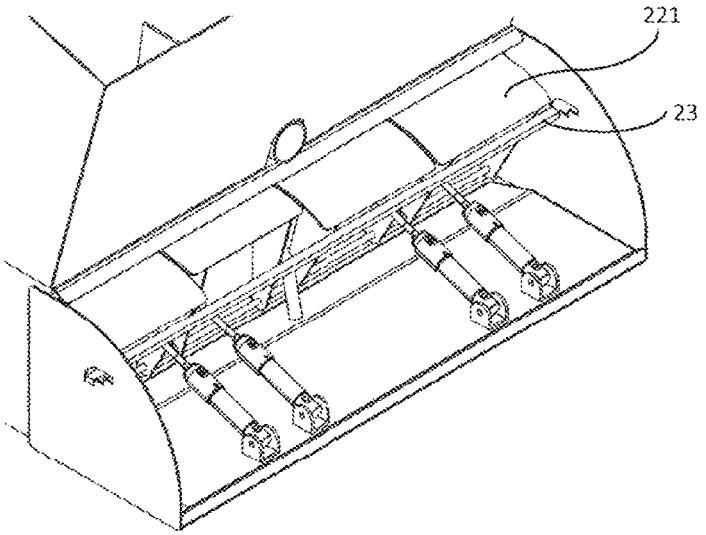
FIG. 11 shows a partial view of the reservoir and the end-of-travel stop of the hatches equipping the reservoir in the minimal open position of the hatches, the end-of-travel stop being active.
Figure 12:
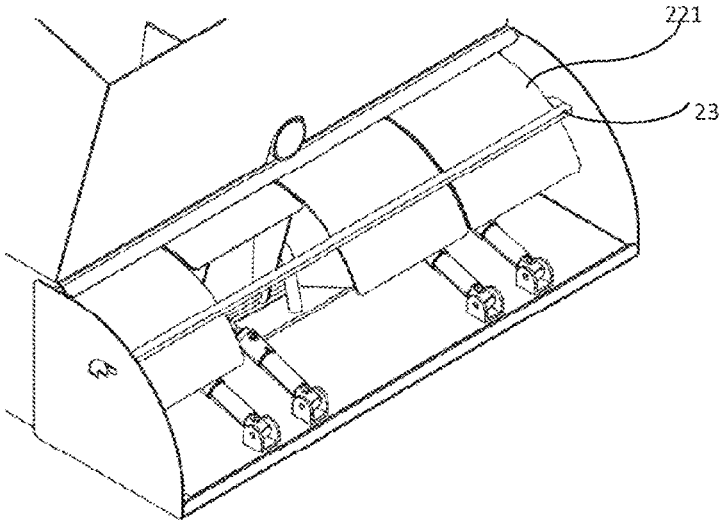
FIG. 12 shows a partial view of the reservoir and the end-of-travel stop of the hatches equipping the reservoir in the open position of the hatches, the end-of-travel stop being inactive.

The reservoir 3 thus made and the smoothing table 4 form an assembly mounted on the chassis 2. The chassis 2 therefore includes a support structure for the reservoir 3 and the smoothing table 4. Said support structure at least partially surrounds the driving means of the wheels 8, via which the chassis 2 rests on the ground. The chassis 2 pre-equipped with the reservoir 3 and the smoothing table 4 is therefore, with the reservoir 3 and the smoothing table 4, mounted tilting around the rotation axis XX' of the wheels 8 via which it rests on the ground, for the passage of said device from a so-called working configuration in which the smoothing table 4 is in bearing contact with the ground to a so-called transport configuration in which the smoothing table 4 is separated from the ground. The transport configuration is illustrated in FIG. 8.

Figure 7:
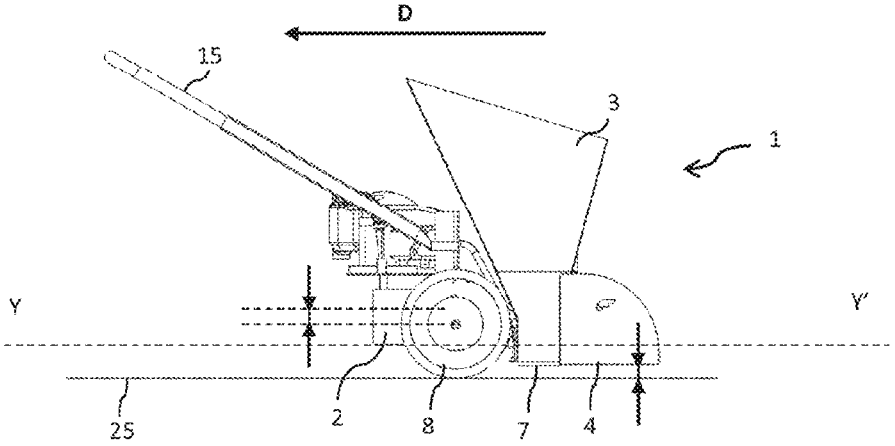
FIGS. 7 and 8 show schematic side views of the device, to illustrate the tilting of the chassis around a rotation axis of the wheels.

In the working configuration, the device may assume a position according to FIG. 7, with the smoothing table 4 bearing on the surface that has already been covered, said covering not being shown in FIG. 7.

To allow the driver of the device 1 to control the tilting, the device 1 is equipped with a U-shaped handlebar 15 on which the driver can bear to command the tilting of the chassis 1, in particular to enter the transport configuration of the device. Generally, under the effect of the weight of the smoothing table and the reservoir, the reservoir tends to tilt naturally in the working configuration when the driver releases his bearing force on the handlebar and has returned the handlebar to a position in which the plane of the table extends horizontally.

The reservoir 3 and the smoothing table 4 form an assembly mounted with an adjustable position on the chassis 2. To that end, adjusting means 91, 92 are provided between the reservoir 3 and the chassis 2. Said adjusting means 91, 92 are provided to allow a movement, jointly movable, of the reservoir 3 and the smoothing table 4. Said adjusting means include two actuators, in the case at hand two jacks 91, 92 with independent actuation, each arranged between the chassis 2 and the reservoir 3.

Thus, each jack 91, 92, which is a double-acting hydraulic jack, is coupled by its rod 11 to the chassis, in particular the part of the chassis surrounding a half-shaft for connecting a wheel to the hydrostatic block. Thus, one of the jacks extends in line with one of the half-shafts and the other jack in line with the other half-shaft. The body of each jack is in turn fastened via an arm 12 to the so-called front transverse wall 18 of the reservoir 3.

In the illustrated example, one of the arms 12 and the front transverse wall 18 of the reservoir 3 are coupled to one another by a pivot link 13 with an axis transverse to the rotation axis XX' of the wheels 8 and parallel to the plane of the smoothing table. Thus, the arm 12 is equipped at its free end with a circular platen that is housed rotating inside a housing arranged, with a complementary shape, on the outer face of the front transverse wall 18 of the reservoir 3. The other of the arms 12 and the front transverse wall 18 of the reservoir are coupled to one another by a pivoting and sliding link 14, the sliding being able to be done along a direction parallel to the leading edge 5 of the smoothing table 4.

To that end, the front transverse wall 18 of the reservoir 3 is equipped with two parallel rails forming a guideway that are arranged in the direction of the width of the device, and the arm is equipped with a circular platen inserted between the parallel rails of said guideway.

Figure 4:
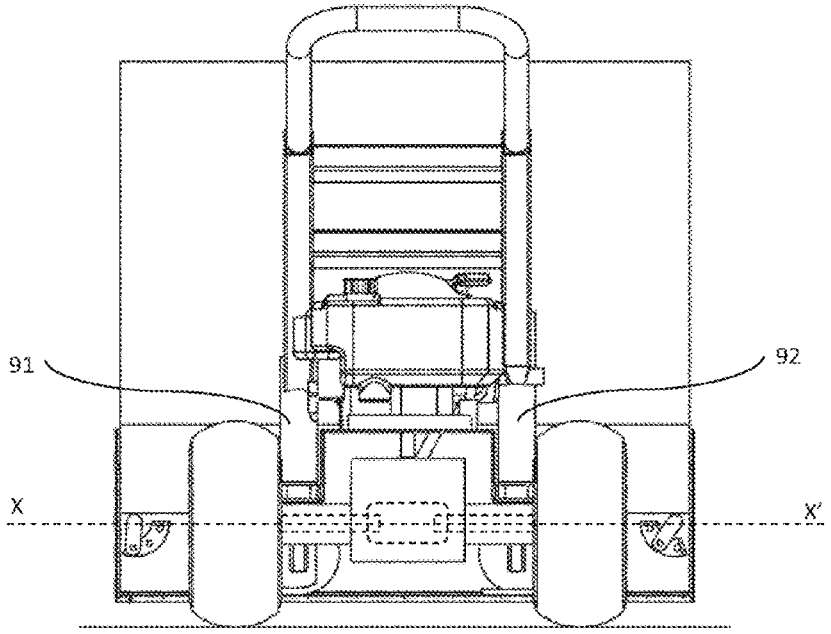
FIG. 4 shows a view from the handlebar side of the device resting on flat ground.

Owing to this assembly in the position shown in FIG. 7, in which the wheels 8 of the rolling chassis 2 rest on horizontal flat ground 25 and the smoothing table 4 extends parallel to the ground, separated from the ground, the driving of the movement of the jack bodies 10 in the direction of an elongation of the jacks drives a raising of the smoothing table 4 and the associated reservoir 3, to allow a height adjustment, depending on the thickness of the layer of bulk materials to be deposited. Thus, the jacks 91, 92 make it possible to raise or lower said assembly 3, 4 in the direction coming closer to or moving further from the ground. Said jacks 91, 92, which can be actuated independently of one another, also make it possible to vary the angle $\alpha$ formed between the plane of the smoothing table 4 and the rotation axis XX' of the wheels. Thus, in the position shown in FIG. 7 or in FIG. 4, the elongation of the jack 92 drives a pivoting movement of the table around the horizontal axis YY' orthogonal to the rotation axis XX' of the wheels, said axis YY' corresponding to the pivot axis of the pivot link 14 of the arm 12 of the jack 91 with the reservoir 3. Said pivoting movement causes tilting of the smoothing table 4 in the direction of the width of the device, i.e., with a slope of the table extending from a high point formed by one of the longitudinal edges of the smoothing table 4 and a low point formed by the other longitudinal edge of the smoothing table 4.

Figure 5:
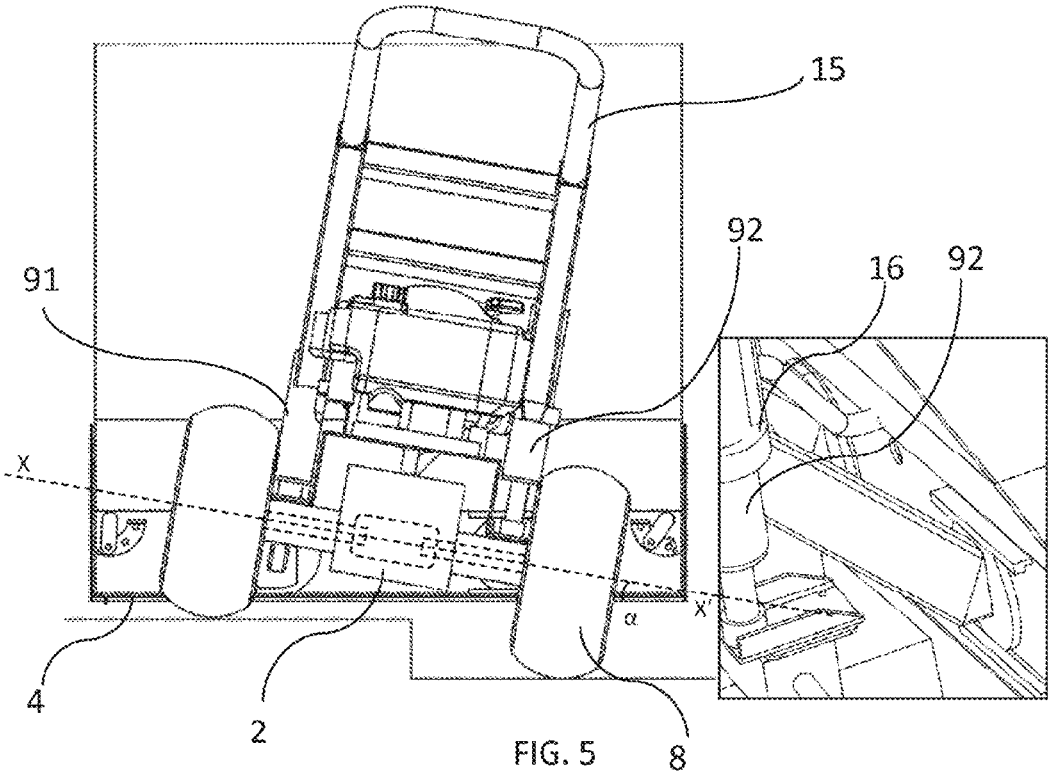
FIG. 5 shows a view, from the handlebar side, of the device resting on inclined ground, during the covering, with the left wheel of the device resting on a surface already covered and the right wheel of the device resting on a surface in the process of being covered, not yet covered and with a detail view of the connection of an actuator to the reservoir.
Figure 6:
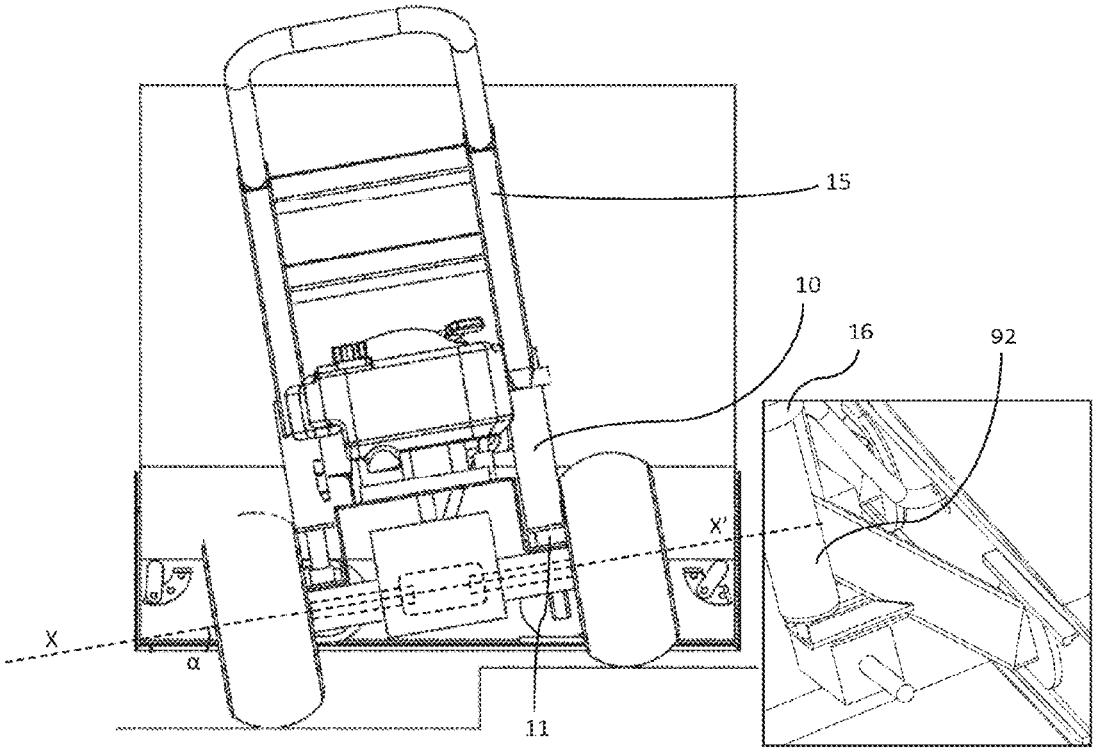
FIG. 6 shows a view, on the handlebar side, of the device resting on inclined ground, in the process of being covered, with the right wheel of the device resting on a surface that has already been covered and the left wheel of the device resting on a surface in the process of being covered, not yet covered.

This adjustment of the incline of the smoothing table 4 thus allows the device to manage a situation according to FIG. 5, in which the wheel 8 located on the side of the jack 92 rests on the surface to be covered, while the wheel 8 located on the side of the jack 91 rests on a surface that has already been covered, therefore located on a higher level. This results in the formation of a step between said surfaces. Despite the presence of said step, one can see that the plane of the smoothing table 4 remains horizontal, due to the acute angle $\alpha$ formed between the rotation axis of the wheels and the bearing plane of the table.

Of course, in the case of a situation where the wheel located on the side of the jack 91 must rest on the surface to be covered, the length of the jack 91 is extended. It is therefore possible, depending on the actuated jacks, to obtain an acute angle $\alpha$ on one side or the other of the device. It is thus possible to maintain the horizontality of the smoothing table 4 when the ground is not flat.

In the illustrated example, the branches of the U of the handlebar 15 couple the core 17 of the handle-forming U to the jacks 91, 92. One of the branches 16 of the U is coupled to one of the jacks 92 so as to be movable by sliding along said U to avoid any deformation of the handlebar during the elongation or the retraction of the jacks.

To allow the deposition of bulk materials on the ground in the form of a bed using a device as described above, the following approach is used: the hatches 221 being in the closed position of the discharge opening of the reservoir 3, said reservoir 3 is filled from the top. The content of the bin of a truck may for example be poured directly via the top into said reservoir 3. Once the reservoir 3 is filled, the device, in the transport configuration, is brought by its driver to the surface to be covered. The driver of the device uses a shim, or prepares in the starting zone of the surface to be covered a base with a thickness corresponding to the thickness of the layer needing to be deposited. The driver of the device makes the adjustments in terms of height and incline of the table and the associated reservoir by acting on the rods of the jacks, controlled in terms of withdrawal or deployment from control members placed at the handlebar of the device, such that the smoothing table 4 rests, after adjustment, horizontally on the shim or the prepared base, while the wheels 8 of the device rest on the surface to be covered, whether or not said surface is flat.

The device is then in the working configuration. The hatches 211 are open, to make it possible to empty the reservoir of the vehicle and deposit bulk materials contained inside the device on the ground.

The device moves with the handlebar forming the front of the device, and the smoothing table behind the device as illustrated by arrow D in FIG. 7. The discharge opening of the reservoir is arranged in front of the smoothing table 4 and the wheels in front of the discharge opening of the reservoir. The shim or the base is therefore behind the device.

The device is steered by the driver of the device acting on the handlebar. The wheels travel first over the surface to be covered. The bulk materials fall by gravity onto the ground, i.e., on the surface to be covered. As the vehicle advances, said deposited bulk materials are smoothed or leveled by the smoothing table 4, which constantly rests bearing on the surface having just been covered.

According to one particular application scenario, i.e., gritting a surface, the device may also be used with an opposite movement direction, i.e., with the smoothing table forming the front of the device. In this case, the opening of the hatches is flanged to a given value and the device is used with this movement direction to perform such gritting.

The invention claimed is:

1. A rolling device for depositing bulk materials onto the ground, the rolling device comprising:

a rolling chassis, equipped with wheels by which the rolling chassis rests on the ground, and a reservoir for storing and distributing the bulk materials; and a smoothing table, the smoothing table having a leading edge arranged along a width of the rolling device and transverse to a direction of movement of the rolling device, the reservoir being provided with, in a lower part forming a bottom of the reservoir, a discharge opening, the discharge opening arranged between the leading edge of the smoothing table and the wheels of the rolling chassis, and configured so as to deposit a bed of the bulk materials with a controlled thickness, wherein the rolling chassis is mounted so as to be tiltable about a rotation axis of the wheels in order for the rolling device to be configurable between a working configuration in which the smoothing table is in contact with the ground and a transport configuration in which the smoothing table is spaced from the ground, wherein the wheels of the rolling chassis are driving wheels, and wherein the reservoir and the smoothing table form a movable assembly, a position of the movable assembly being adjustable via adjusting means configured to allow, at least in a configuration in which the wheels rest on a horizontal flat ground and the smoothing table extends parallel to and spaced from the ground, i) an adjustment of a height of the smoothing table and the discharge opening so as to alternately raise and lower the movable assembly and thereby alternately move the movable assembly further and closer to the ground, and ii) an adjustment of an incline of the smoothing table so as to form a non-zero angle between a plane of the smoothing table and the rotation axis of the wheels.

2. The rolling device according to claim 1, wherein the adjusting means configured for the adjustment of the height and the adjustment of the incline of the smoothing table are at least partially shared.

3. The rolling device according to claim 1, wherein the adjusting means include first and second actuators actuated independently, each one of said first and second actuators being arranged between the chassis and the movable assembly.

4. The rolling device according to claim 3, wherein each one of the first and second actuators is a jack, a rod of the jack being fastened to the chassis, and a body of the jack being fastened via an arm to the movable assembly.

5. The rolling device according to claim 4, wherein a longitudinal axis of the jack extends orthogonally to the rotation axis of the wheels.

6. The rolling device according to claim 4, wherein the movable assembly and the arm of the first of the jacks are coupled to one another via a pivot link with an axis transverse to the rotation axis of the wheels and parallel to the plane of the smoothing table, and said movable assembly and the arm of the second of the jacks are coupled to one another by a link with pivoting and sliding, the sliding being along a direction parallel to the leading edge of the smoothing table.

7. The rolling device according to claim 4, further comprising:

a U-shaped handlebar, branches of the U of the U-shaped handlebar coupling the U-shaped handlebar to the jacks, wherein one of the branches of the U of the U-shaped handlebar is coupled to one of the jacks so as to be movable by sliding along said one of the jacks.

8. The rolling device according to claim 1, wherein a top of the reservoir is open, and the reservoir is delimited by a front transverse wall, a rear transverse wall, and two side longitudinal walls, wherein the leading edge of the table extends at the base of the rear wall of the reservoir, and wherein the discharge opening is a closable opening.

9. The rolling device according to claim 8, wherein the reservoir is compartmentalized by partitions extending parallel to a longitudinal axis of the device running along the direction movement, wherein the closable opening is closable by closing means for closing the discharge opening that includes a series of hatches arranged side by side along a direction of the width of the rolling device, the hatches being mounted movably between a closed position that closes the discharge opening in which the hatches are separated from one another by a partition, and an open position that opens the discharge opening in which the hatches at least partially protrude from the reservoir, at least one of the hatches being movable between the closed position and the open position independently of the other hatches, and wherein the rolling device is equipped with an end-of-travel stop for the hatches in the open position, a position of the end-of-travel stop being adjustable.

10. The rolling device according to claim 8, wherein the reservoir includes two flaps for adjusting a width of the bed of bulk materials, each flap of the two flaps extending below the closing means in the closed position, an upper edge of each flap being coupled to a side wall of the reservoir by a pivot link with a pivot axis parallel to the plane of the smoothing table for passage of the flap from a position pressed against the side wall to a position separated from the side wall.

* * * * *